US010567867B2

(12) United States Patent
Kinoshita et al.

(10) Patent No.: US 10,567,867 B2
(45) Date of Patent: Feb. 18, 2020

(54) EXTERNALLY DUCTED VEHICLE LOUDSPEAKER

(71) Applicant: Bose Corporation, Framingham, MA (US)

(72) Inventors: Takashi Kinoshita, Yokohama (JP); Ben John Feng, Sudbury, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/117,080

(22) Filed: Aug. 30, 2018

(65) Prior Publication Data

US 2019/0075392 A1 Mar. 7, 2019

Related U.S. Application Data

(60) Provisional application No. 62/554,279, filed on Sep. 5, 2017.

(51) Int. Cl.
*H04R 1/28* (2006.01)
*H04R 1/02* (2006.01)

(52) U.S. Cl.
CPC ..... *H04R 1/2834* (2013.01); *H04R 1/025* (2013.01); *H04R 2499/13* (2013.01)

(58) Field of Classification Search
CPC .... H04R 1/2834; H04R 1/2803; H04R 1/025; H04R 7/00; H04R 9/025; H04R 1/2819; H04R 1/021; H04R 1/026; H04R 2499/13; H04R 1/283
USPC ..... 381/86
See application file for complete search history.

(56) References Cited

U.S. PATENT DOCUMENTS 5,394,478 A * 2/1995 Hathaway ..... H04R 1/2842 181/160
6,128,394 A 10/2000 Hayakawa et al.
6,912,290 B1 6/2005 Thorsell et al.
8,708,092 B2 4/2014 Ito et al.
(Continued)

FOREIGN PATENT DOCUMENTS

EP 0904985 B9 3/1993
EP 2077680 B1 11/2013
JP 2012015703 A 1/2012

OTHER PUBLICATIONS

International Search Report and Written Opinion for International Application No. PCT/US2018/048709, dated Nov. 15, 2018, 12 pages.

*Primary Examiner* — Disler Paul
(74) *Attorney, Agent, or Firm* — Hoffman Warnick LLC

(57) ABSTRACT

Various implementations include vehicle loudspeakers and related vehicle audio systems. In some particular implementations, a loudspeaker for a vehicle includes: a transducer to radiate sound into an interior space of the vehicle; and an assembly coupled to a rear side of the transducer, the assembly including an enclosure and a passive radiator, the assembly disposed such that acoustic energy radiated from the rear side of the transducer passes through the enclosure and excites the passive radiator, causing the passive radiator to radiate acoustic energy to a region outside of the interior space of the vehicle, where a resonant frequency of the transducer is dependent on at least one characteristic of the passive radiator, and a resonant frequency of the enclosure is dependent on at least one characteristic of the enclosure.

19 Claims, 9 Drawing Sheets

(56) References Cited

U.S. PATENT DOCUMENTS

| | | | | |
|---|---|---|---|---|
| 8,804,991 | B2 | 8/2014 | Velican | |
| 8,837,762 | B2 | 9/2014 | Tada | |
| 9,025,790 | B2 | 5/2015 | Tada | |
| 9,315,159 | B2 * | 4/2016 | Muller | B60J 5/0413 |
| 10,362,386 | B2 * | 7/2019 | Jaguste | H04R 1/2842 |
| 2007/0003076 | A1 * | 1/2007 | Croft, III | H04R 1/2842 381/98 |
| 2010/0092006 | A1 | 4/2010 | Rosen | |
| 2013/0142380 | A1 | 6/2013 | Tada | |
| 2013/0188806 | A1 | 7/2013 | Tada | |
| 2017/0353787 | A1 * | 12/2017 | Gunness | H04R 1/2842 |
| 2018/0027321 | A1 * | 1/2018 | Jaguste | H04R 1/2834 381/59 |
| 2018/0310082 | A1 * | 10/2018 | Amae | H04R 1/021 |

* cited by examiner

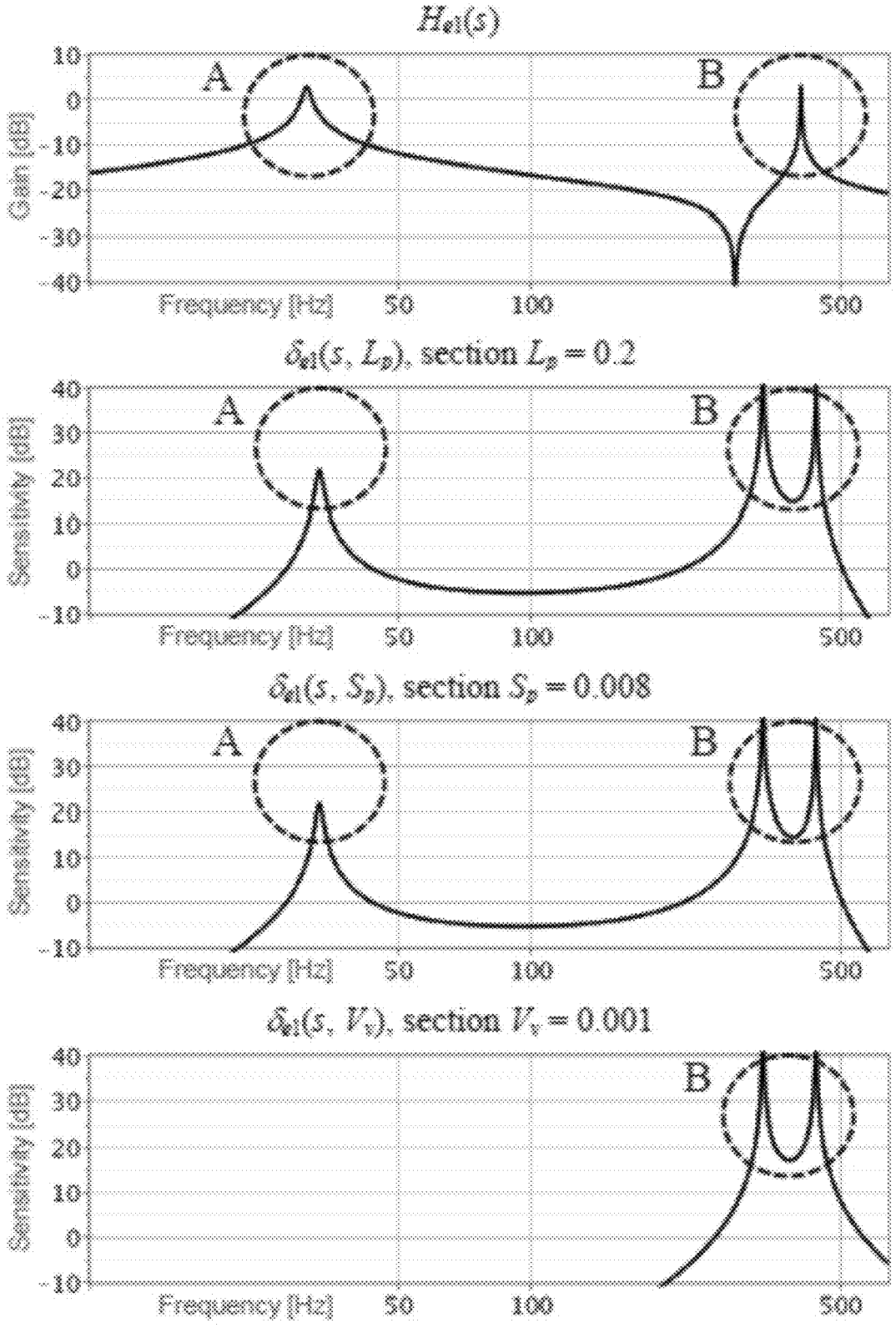
FIG. 6. Magnitude response of $H_{e1}(s)$ and $\delta_{e1}(s, X)$

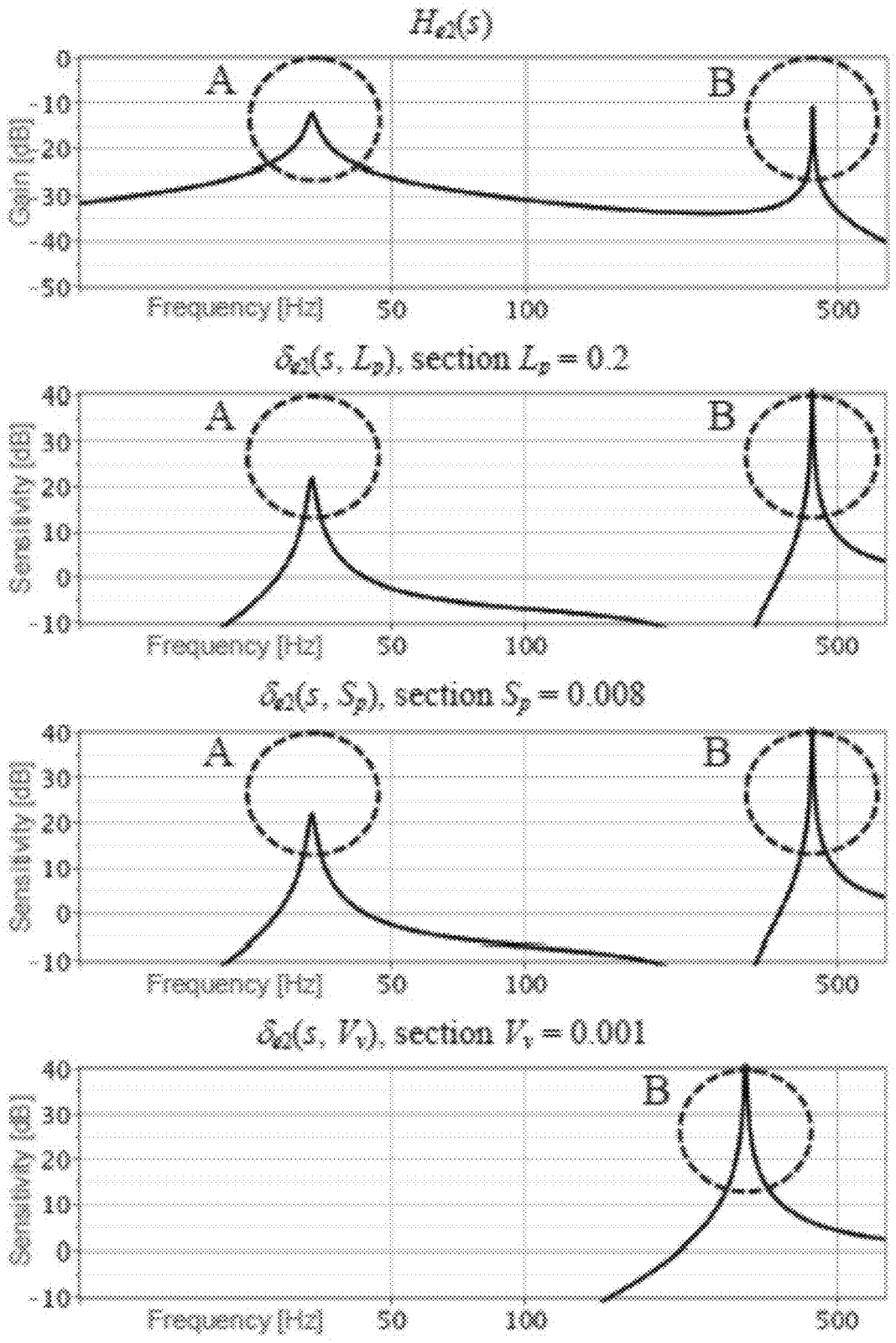
FIG. 7. Magnitude response of $H_{e2}(s)$ and $\delta_{e2}(s, X)$

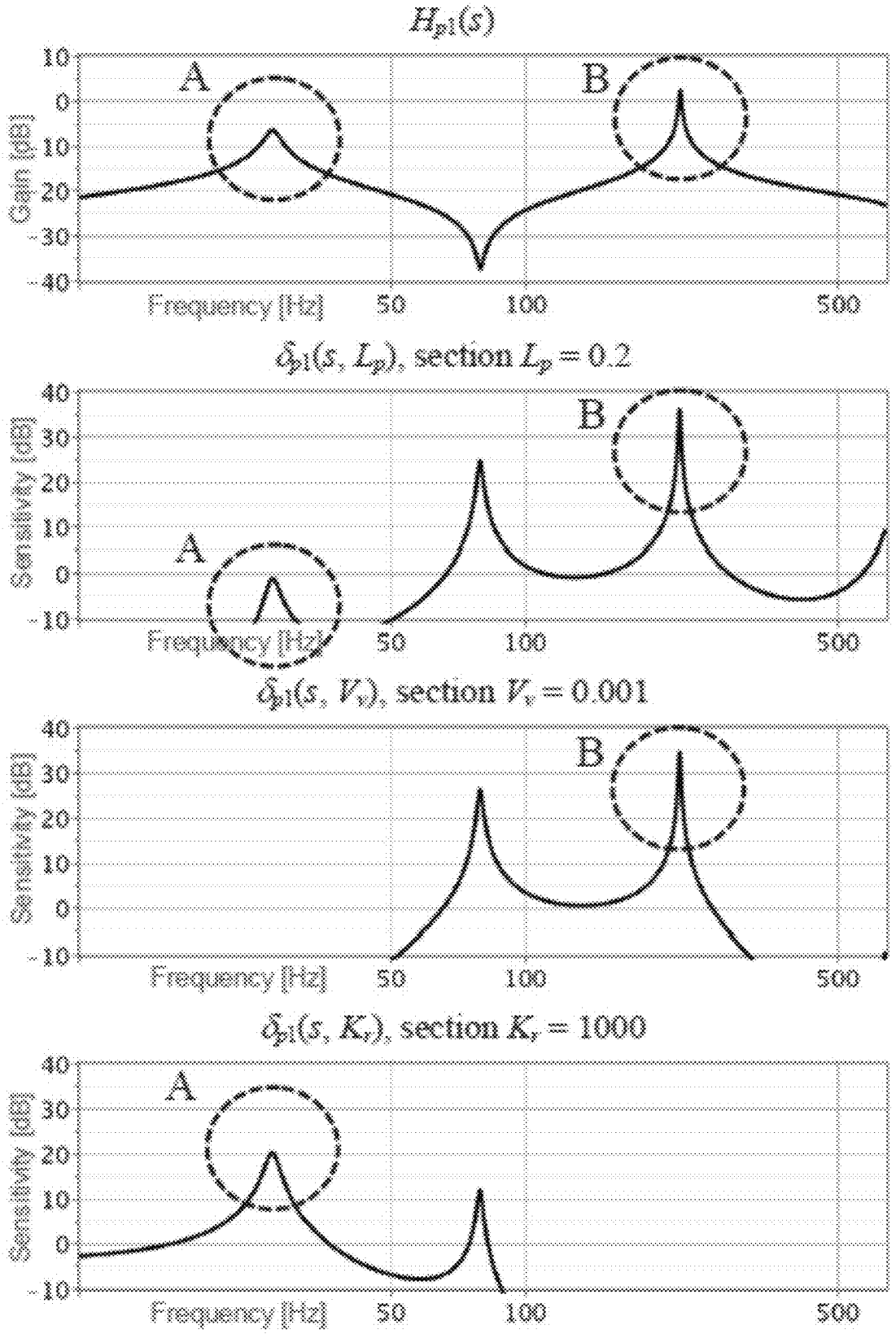
FIG. 8. Magnitude response of $H_{p1}(s)$ and $\delta_{p1}(s, X)$

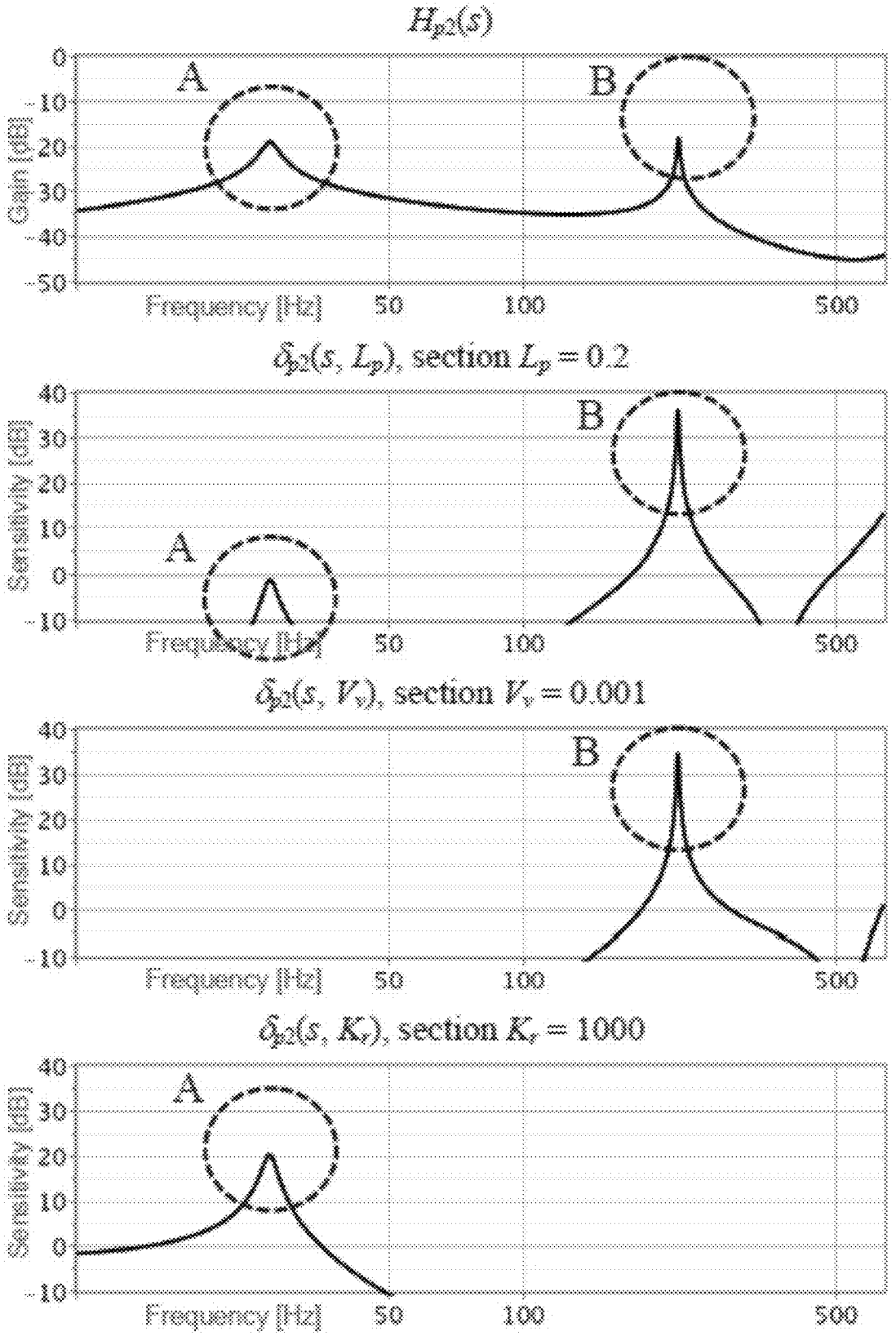
FIG. 9. Magnitude response of $H_{p2}(s)$ and $\delta_{p2}(s, X)$

EXTERNALLY DUCTED VEHICLE LOUDSPEAKER

CROSS-REFERENCE TO RELATED APPLICATION

This application claims priority to U.S. Provisional Application No. 62/554,279, filed on Sep. 5, 2017, which is hereby incorporated by reference in its entirety.

TECHNICAL FIELD

This disclosure generally relates to vehicle audio systems. More particularly, the disclosure relates to a ducted vehicle loudspeaker and related vehicle audio systems.

BACKGROUND

The reproduction of low frequency sound in a vehicle can be difficult, mainly due to the need to generate significant levels of volume velocity, combined with the practical limitations on the dimensions of the vehicle speaker system. For a speaker system that utilizes a sealed enclosure, the enclosure volume should be large enough to avoid raising the transducer unit's resonance frequency. For a speaker system that utilizes a traditional ported/vented enclosure, the enclosure dimensions should be large enough to obtain the desired output from the port. Both of these approaches usually face implementation challenges due to the cabin space required to package the enclosure. Some more recently advanced systems use a transducer with a vented duct to control low frequency sound in a vehicle. However, these ducted transducers can introduce an additional challenge, namely the introduction of exterior noise into the vehicle cabin via the duct.

SUMMARY

All examples and features mentioned below can be combined in any technically possible way.

Various implementations include loudspeakers for vehicles. In some particular implementations, a vehicle loudspeaker is ducted to a region external to the vehicle cabin.

Some particular aspects include a loudspeaker for a vehicle, the loudspeaker including: a transducer to radiate sound into an interior space of the vehicle; and an assembly coupled to a rear side of the transducer, the assembly including an enclosure and a passive radiator, the assembly disposed such that acoustic energy radiated from the rear side of the transducer passes through the enclosure and excites the passive radiator, causing the passive radiator to radiate acoustic energy to a region outside of the interior space of the vehicle, where a resonant frequency of the transducer is dependent on at least one characteristic of the passive radiator, and a resonant frequency of the enclosure is dependent on at least one characteristic of the enclosure.

Additional particular aspects include an automobile with a loudspeaker, the loudspeaker including: a transducer to radiate sound into an interior space of the vehicle; and an assembly coupled to a rear side of the transducer, the assembly including an enclosure and a passive radiator, the assembly disposed such that acoustic energy radiated from the rear side of the transducer passes through the enclosure and excites the passive radiator, causing the passive radiator to radiate acoustic energy to a region outside of the interior space of the vehicle, where a resonant frequency of the transducer is dependent on at least one characteristic of the passive radiator, and a resonant frequency of the enclosure is dependent on at least one characteristic of the enclosure.

Implementations may include one of the following features, or any combination thereof.

In certain aspects, the enclosure includes a chamber, and the resonant frequency of the transducer is dependent on: a volume of the chamber, a cross-sectional area of the passive radiator, a mass of the passive radiator, a loss factor of the passive radiator and a stiffness of the passive radiator. In some cases, the enclosure further includes a duct that couples the passive radiator to the chamber. In particular implementations, the resonant frequency of the transducer is further dependent on acoustic properties of the duct. In certain cases, the resonant frequency of the transducer is further dependent on a cross-sectional area of the duct and a length of the duct. In some implementations, the cross-sectional area of the duct remains approximately constant along the length of the duct. In particular aspects, the cross-sectional area of the duct varies along the length of the duct from the transducer to the passive radiator.

In certain cases, the transducer is coupled to a proximal end of the enclosure and the passive radiator is coupled to a distal end of the enclosure.

In some aspects, the interior space of the vehicle includes a passenger cabin of the vehicle. In particular implementations, the region outside of the interior space of the vehicle includes a space that is exterior to a body of the vehicle. In certain cases, the region outside of the interior space of the vehicle includes a space within a body of the vehicle. In some implementations, the space within the body of the vehicle includes a space within a door of the vehicle, a space within a trunk of the vehicle, a space within a dashboard of the vehicle, a space within a floor of the vehicle, a space within a headboard of the vehicle, a space within a seat of the vehicle, a space within a cargo load of the vehicle, a space within a bumper of the vehicle, a space within a fender panel of the vehicle, or a space within a structural member of the vehicle.

In particular cases, the passive radiator limits a correlation between the resonant frequency of the enclosure and the resonant frequency of the transducer.

In certain aspects, the enclosure includes a space defined by a set of walls enveloping the rear side of the transducer. In particular implementations, the passive radiator is located at least partially within the set of walls of the enclosure. In some cases, the enclosure has a length measured from the rear side of the transducer to the passive radiator, and the enclosure has a cross-sectional area along the length that is either constant or varied. In certain implementations, the enclosure has a length measured from the rear side of the transducer to the passive radiator, where the enclosure has a constant cross-sectional area along the length, and the passive radiator has an outer dimension that is smaller than an inner dimension of the enclosure.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

BRIEF DESCRIPTION OF THE DRAWINGS

FIG. 6 shows a first set of magnitude response graphs for the conventional loudspeaker configuration referenced in FIG. 1.

FIG. 7 shows a second set of magnitude response graphs for the conventional loudspeaker configuration referenced in FIG. 1.

FIG. 8 shows a first set of magnitude response graphs for a loudspeaker configuration disclosed according to various implementations.

FIG. 9 shows a second set of magnitude response graphs for a loudspeaker configuration disclosed according to various implementations.

Figure 1:
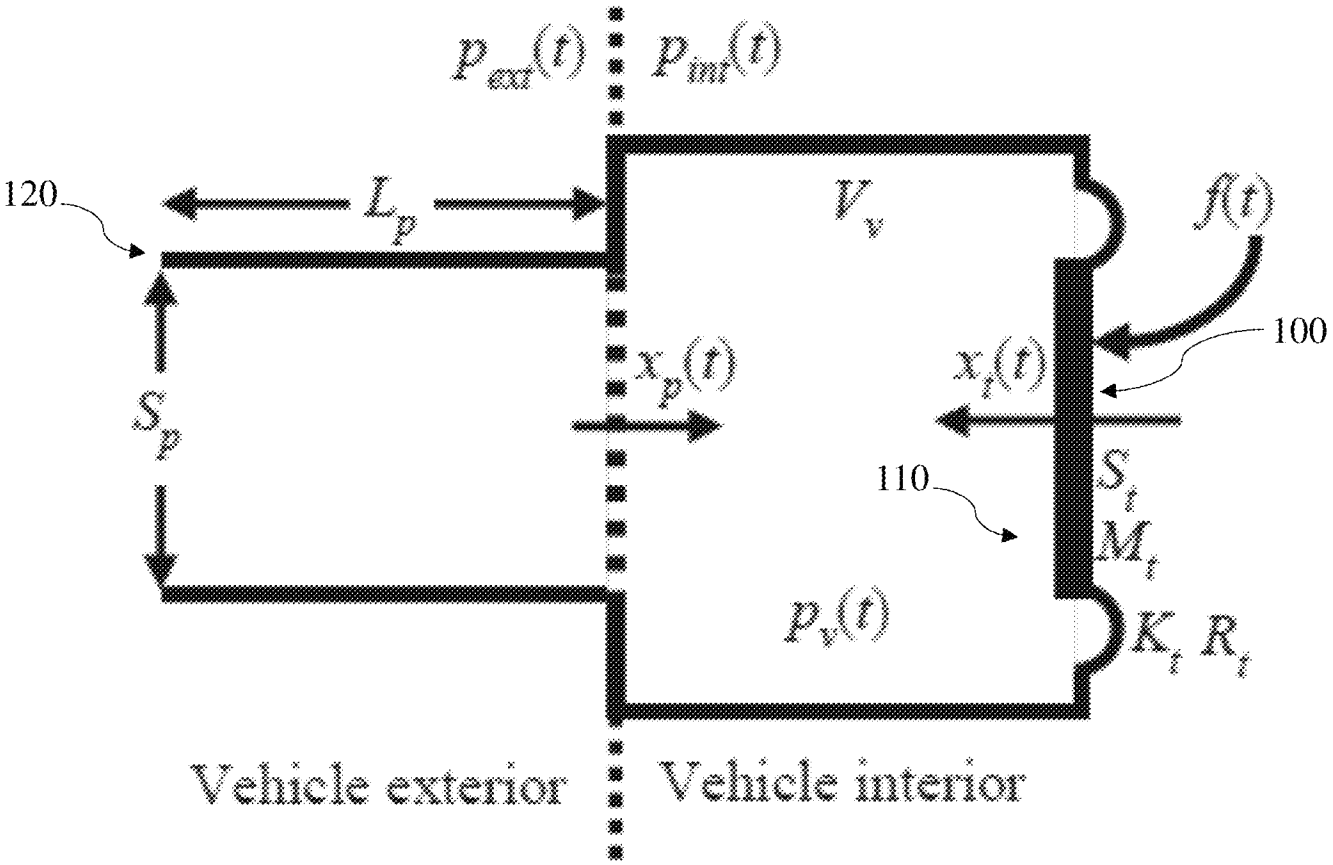
FIG. 1 shows a mathematical model of a conventional loudspeaker configuration.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a loudspeaker configuration can be beneficially incorporated into a vehicle audio system. For example, a vehicle audio system can be configured with at least one loudspeaker having a transducer and an assembly coupled to a rear side of the transducer, the assembly including an enclosure and a passive radiator. The assembly is disposed such that acoustic energy radiated from the rear side of the transducer passes through the enclosure and excites the passive radiator. The assembly can significantly improve the user experience when compared with conventional vehicle audio systems, for example, by partially isolating the internal and external noise considerations.

Commonly labeled components in the FIGURES are considered to be substantially equivalent components for the purposes of illustration, and redundant discussion of those components is omitted for clarity.

As described herein, some more recently advanced vehicle audio systems use a transducer with a vented duct to control low frequency sound. In particular examples, transducers have been introduced in vehicle audio systems without back-side enclosures (e.g., infinite baffle loading), where the back side of these transducers is exterior to the vehicle cabin. An example of such a system is disclosed in U.S. Pat. No. 8,804,991 (Velican, or the '991 patent). In the '991 patent, a speaker system is described as including a transducer that communicates with an exterior of the vehicle cabin via a tuned duct. This configuration is illustrated in an acoustic model diagram in FIG. 1, and can aid in isolating the sound from the front of the transducer relative to the back of the transducer without raising the transducer resonance frequency. The transducer 100 is shown including a backside 110 that is open to the exterior of the vehicle cabin via a duct 120 (where "vehicle" exterior in FIG. 1 refers to exterior of the passenger cabin). The configuration in FIG. 1 can enable reproduction of lower frequency sound without a large enclosure volume. Additionally, this configuration permits adjustment of the mechanical resonance of the transducer (which defines the lower limit of the sound reproduction frequency range) using the mass loading on the duct system. While this configuration allows for control of the transducer resonance without modifying the transducer itself, it has drawbacks. For example, by coupling the interior of the vehicle cabin with the exterior of the vehicle cabin, the system in the '991 patent provides a path for exterior noise to enter the cabin, potentially degrading the noise performance of the vehicle where the duct system resonates.

Figure 2:
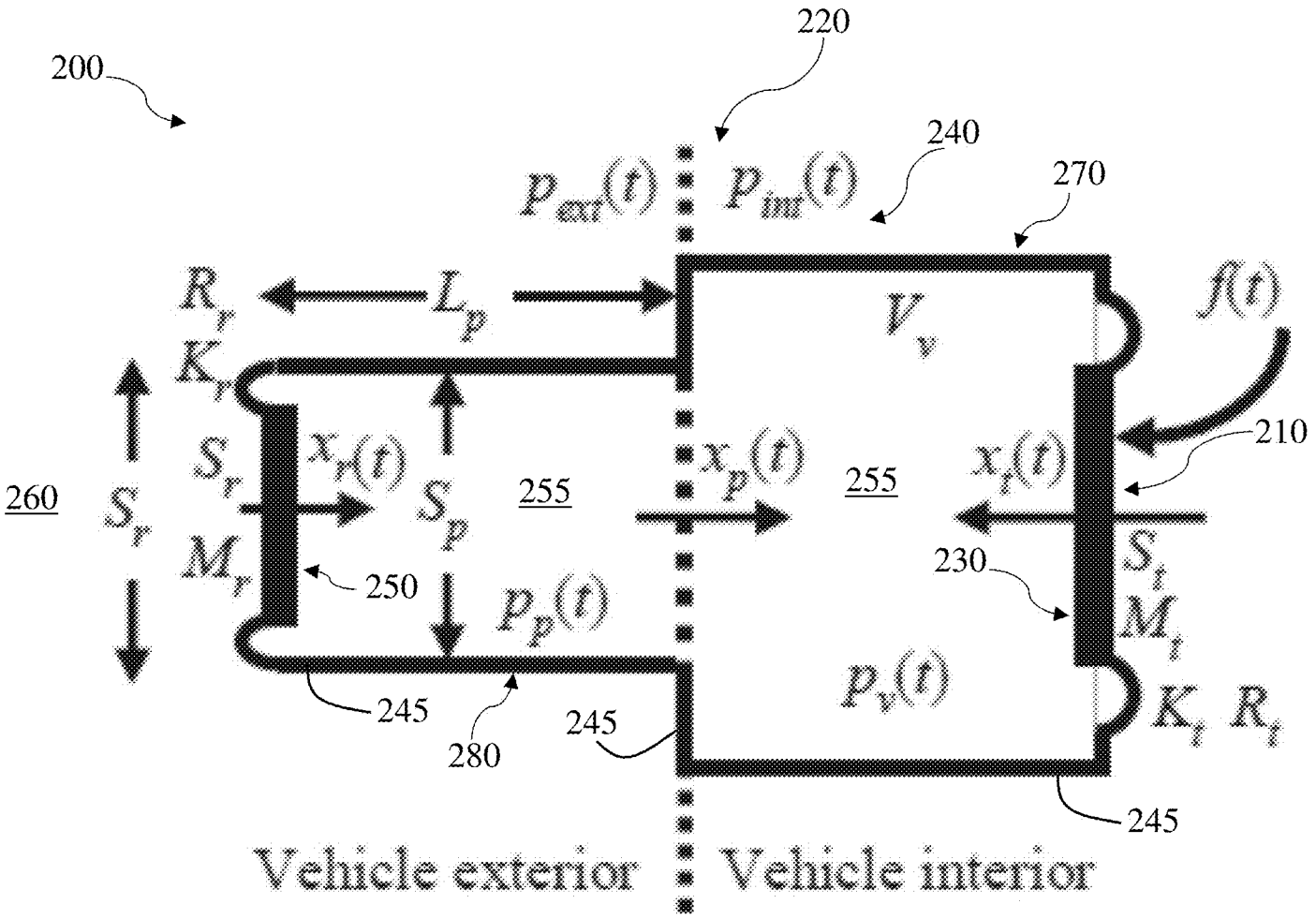
FIG. 2 shows a mathematical model of a loudspeaker configuration according to various implementations.

FIG. 2 illustrates an acoustic model of a loudspeaker 200 according to various implementations, where the loudspeaker 200 is located in a vehicle having an interior and an exterior. As noted herein, "vehicle interior" refers to space within the passenger cabin of the vehicle, while "vehicle exterior" refers to any space outside of the passenger cabin of the vehicle. As described herein, the interior and exterior can be acoustically separated by any wall that defines the passenger cabin, e.g., a door panel, floor panel, overhead panel, seat/seat panel, dashboard, etc. As further described herein, the loudspeaker 200 can be used in various locations in a vehicle to provide enhanced noise control while enabling reproduction of quality low frequency sound.

In contrast to the conventional system in FIG. 1, as shown in FIG. 2, various implementations include a loudspeaker 200 including a transducer 210 and an assembly 220 coupled to a rear side 230 of the transducer 210. The assembly 220 can include an enclosure 240 and a passive radiator 250. In this example implementation, the transducer 210 is coupled to a proximal end of the enclosure 240, and the passive radiator 250 is coupled to a distal end of the enclosure 240. The enclosure 240 includes a set of walls 245 defining a space 255 at the rear side of the transducer 210. That is, walls 245 envelop the rear side 230 of the transducer 210. The walls 245 can be formed of any conventional speaker enclosure material, e.g., a metal, plastic or composite material. In various implementations, the passive radiator 250 is integrated into one of the walls 245 of the enclosure 240, or may form one of the walls 245 of the enclosure 240. In particular implementations, such as illustrated in FIG. 2, the passive radiator 250 can have a smaller outer dimension (e.g., outer diameter, or width) than the transducer 210.

The assembly 220 is disposed such that acoustic energy radiated from the rear side 230 of the transducer 210 passes through the enclosure 240 and excites the passive radiator 250. Exciting the passive radiator 250 in this scenario causes the passive radiator 250 to radiate acoustic energy to a region 260 outside of the interior space of the vehicle (vehicle interior).

The transducer 210 can include any conventional transducer device, such as an exciter and/or a speaker. For example, the transducer 210 can include an exciter with a voice coil, a suspension system, electrical connection terminals, and a coupling plate or ring that joins the voice coil to a mounting surface, in this case, a portion of the vehicle interior. In other examples, the transducer 210 can include a speaker with a larger speaker element and a smaller speaker element, e.g., a tweeter and a low-to-mid range speaker element. In another arrangement, the smaller speaker is a mid-to-high frequency speaker element and the larger speaker is a woofer, or low-frequency speaker element. The two or more elements may be combined into a single enclosure or may be installed separately. The speaker elements in each set may be driven by a single amplified signal from an amplifier, with a passive crossover network (which may be embedded in one or both speakers) distributing signals in different frequency ranges to the appropriate speaker elements. In other examples, full range speakers are used, and in still other examples, more than two speakers are used per set. Each individual speaker described herein may also be implemented as an array of speakers, which may allow more sophisticated shaping of the sound, or simply a more economical use of space and materials to deliver a given sound pressure level.

The passive radiator 250 acts as a conventional passive acoustic device to radiate sound, for example, low frequency sound. The passive radiator 250 can be a specifically devised passive device, such as a transducer without a voice coil or magnet, or can include similar components as a conventional speaker (e.g., transducer 210) without receiving a power signal or having a power connection. In particular cases, the passive radiator 250 can include a diaphragm mounted with a compliant suspension system. In any case, the passive radiator 250 does not receive a power signal (or is otherwise not powered) and radiates sound generated by other nearby devices in the system (e.g., the transducer 210).

In some implementations, the enclosure 240 includes a chamber 270, for example, a set of walls or a housing around a back side of the transducer 210. In these cases, the resonant frequency of the transducer 210 is dependent on a plurality of characteristics in the loudspeaker 200, e.g.: a volume of the chamber 270, a cross-sectional area of the passive radiator 250, a mass of the passive radiator 250, a loss factor of the passive radiator 250 and a stiffness of the passive radiator 250. In certain example implementations, the resonant frequency of the transducer 210 can be dependent upon all of these characteristics.

Figure 3:
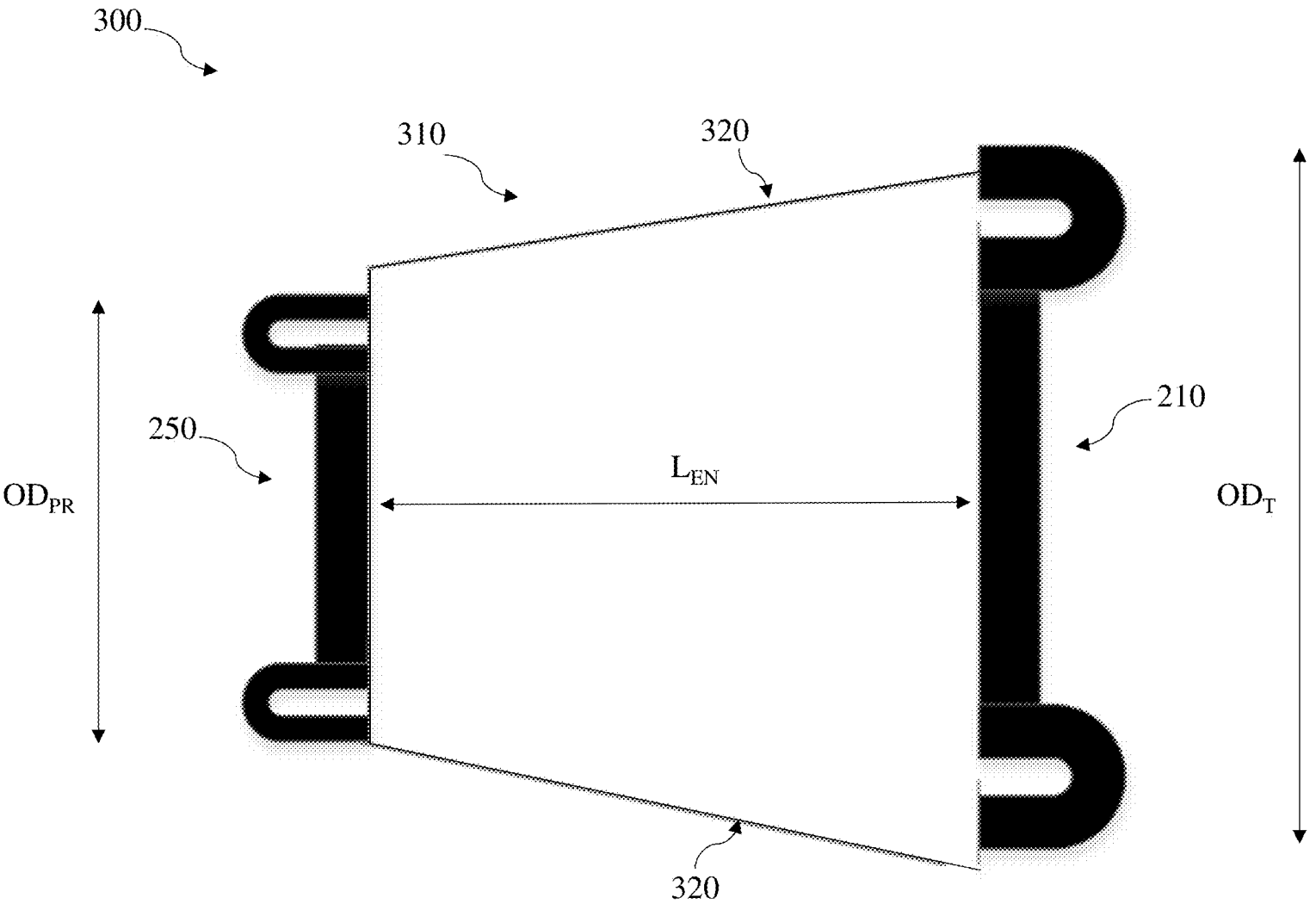
FIG. 3 is a schematic depiction of an additional loudspeaker configuration according to various implementations.
Figure 4:
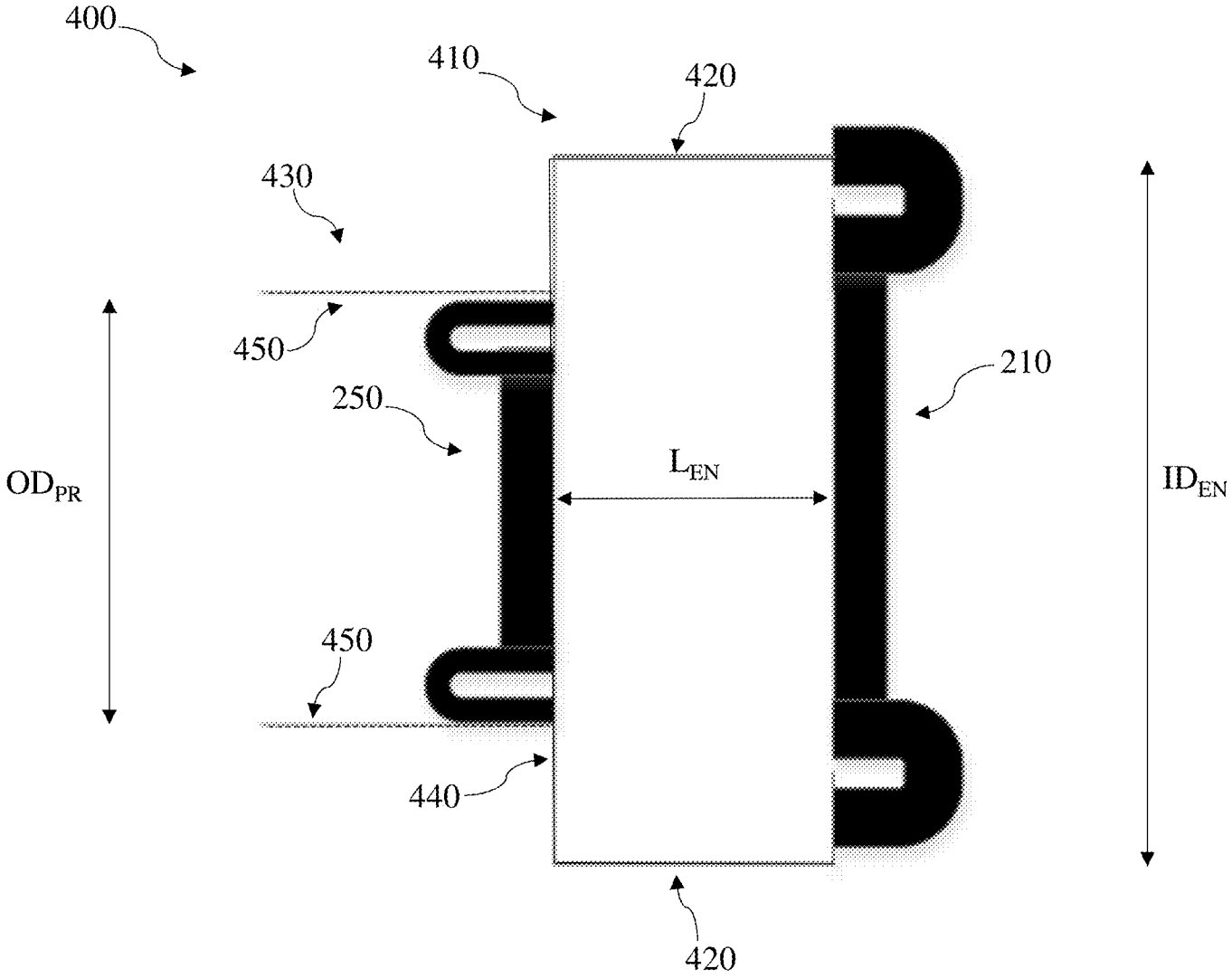
FIG. 4 is a schematic depiction of another loudspeaker configuration according to various implementations.

In particular implementations, the enclosure 240 includes a duct 280 that couples the passive radiator 250 to the chamber 270. The duct 280 has a smaller cross-sectional area ($S_p$) along its length ($L_p$) than the remainder of the enclosure 240 (e.g., area labeled as chamber 270). This implementation is demonstrated in the model in FIG. 2. However, as described herein, other implementations may not include a duct (e.g., as shown in FIGS. 3 and 4).

In the case that the enclosure 240 includes the duct 280, the resonant frequency of the transducer 210 can be further dependent on acoustic properties of the duct 280. For example, the resonant frequency of the transducer 210 can be dependent on the cross-sectional area ($S_p$) of the duct 280, as well as the length ($L_p$) of the duct 280.

In some particular cases, as illustrated in FIG. 2, the cross-sectional area ($S_p$) of the duct 280 remains approximately constant along the length ($L_p$) of the duct 280 (e.g., +/−a margin such as a measurement error or nominal manufacturing error, up to 1-2%). However, in other cases, the cross-sectional area ($S_p$) of the duct can vary along the length ($L_p$), for example, by tapering in the direction from the transducer 210 to the passive radiator 250, flaring outward in the direction from the transducer 210 to the passive radiator 250, or including contours, pockets or edges. As described herein, in some cases, the passive radiator 250 is located at the distal end of the enclosure 240, and is located at least partially within the rear wall of the enclosure 240. In this example implementation, the passive radiator 250 forms the rear wall of the enclosure 240.

However, in other implementations, the passive radiator 250 can be located on any wall of the enclosure 240 that is external to the vehicle interior, or backs up to the vehicle exterior. That is, the passive radiator 250 can be located on a sidewall or form a portion of a sidewall located in the vehicle exterior, or which abuts the vehicle exterior.

FIGS. 3 and 4 respectively illustrate additional implementations of loudspeakers 300, 400. FIG. 3 shows a loudspeaker 300 including an enclosure 310 having sidewalls 320 which taper from the transducer 210 to the passive radiator 250. That is, the cross-sectional area of the enclosure 310 is varied along the length ($L_{EN}$) of the enclosure 310. In this implementation, the passive radiator 250 is located at the distal end of the enclosure 310 (e.g., at least partially within the rear wall of the enclosure 310), opposite the transducer 210. As also shown in FIG. 3, and similar to loudspeaker 200 in FIG. 2, in some cases, the outer dimension ($OD_{PR}$) (e.g., outer diameter or width) of the passive radiator 250 can be smaller than the outer dimension ($OD_T$) of the transducer 210. In some implementations, the loudspeaker 300 can be positioned such that substantially all of the enclosure 310 and the passive radiator 250 are located in the vehicle exterior. However, in other implementations, the loudspeaker 300 can be positioned such that a portion of the enclosure 310 is located in the vehicle exterior (along with the passive radiator 250). In still further implementations, the loudspeaker 300 can be positioned such that substantially all of the enclosure 310 is located in the vehicle interior, where the passive radiator 250 abuts the separation between the vehicle interior and the vehicle exterior (e.g., as part of a panel or wall separating the cabin of the vehicle from the vehicle exterior).

FIG. 4 illustrates a loudspeaker 400 including an enclosure 410 having sidewalls 420 with an approximately constant cross-sectional area along the length ($L_{EN}$) of the enclosure 410. The loudspeaker 400 can include a transducer 210 and a passive radiator 250 opposing one another on the enclosure 410. In some cases, the passive radiator 250 forms part of one of the walls 420 of the enclosure 410, e.g., a portion of the rear wall of the enclosure 410. As shown in the example configuration in FIG. 4, the enclosure 410 has a length ($L_{EN}$) measured from the rear side of the transducer 210 to the passive radiator 250, where the enclosure 410 has a constant cross-sectional area along the length ($L_{EN}$). In this example configuration, the passive radiator 250 has an outer dimension ($OD_{PR}$) (e.g., outer diameter or width) that is smaller than an inner dimension ($ID_{EN}$) (e.g., inner diameter or width) of the enclosure 410.

In the example configuration in FIG. 4, the enclosure 410 can optionally include a duct 430 extending outward from a first portion 440 of the enclosure behind the passive radiator 250. This duct 430 is illustrated in dashed lines. In this case, the passive radiator 250 forms part of the wall of the first portion 440, and the duct 430 includes walls 450 extending from the first portion 440 beyond the back of the passive radiator 250. These walls 450 can be open to the vehicle exterior in various implementations.

In some implementations, the loudspeaker 400 can be positioned such that substantially all of the enclosure 410 and the passive radiator 250 are located in the vehicle exterior. However, in other implementations, the loudspeaker 400 can be positioned such that a portion of the enclosure 410 is located in the vehicle exterior (along with the passive radiator 250). In still further implementations, the loudspeaker 400 can be positioned such that substantially all of the enclosure 410 is located in the vehicle interior, where the passive radiator 250 abuts the separation between the vehicle interior and the vehicle exterior (e.g., as part of a panel or wall separating the cabin of the vehicle from the vehicle exterior).

Figure 5:
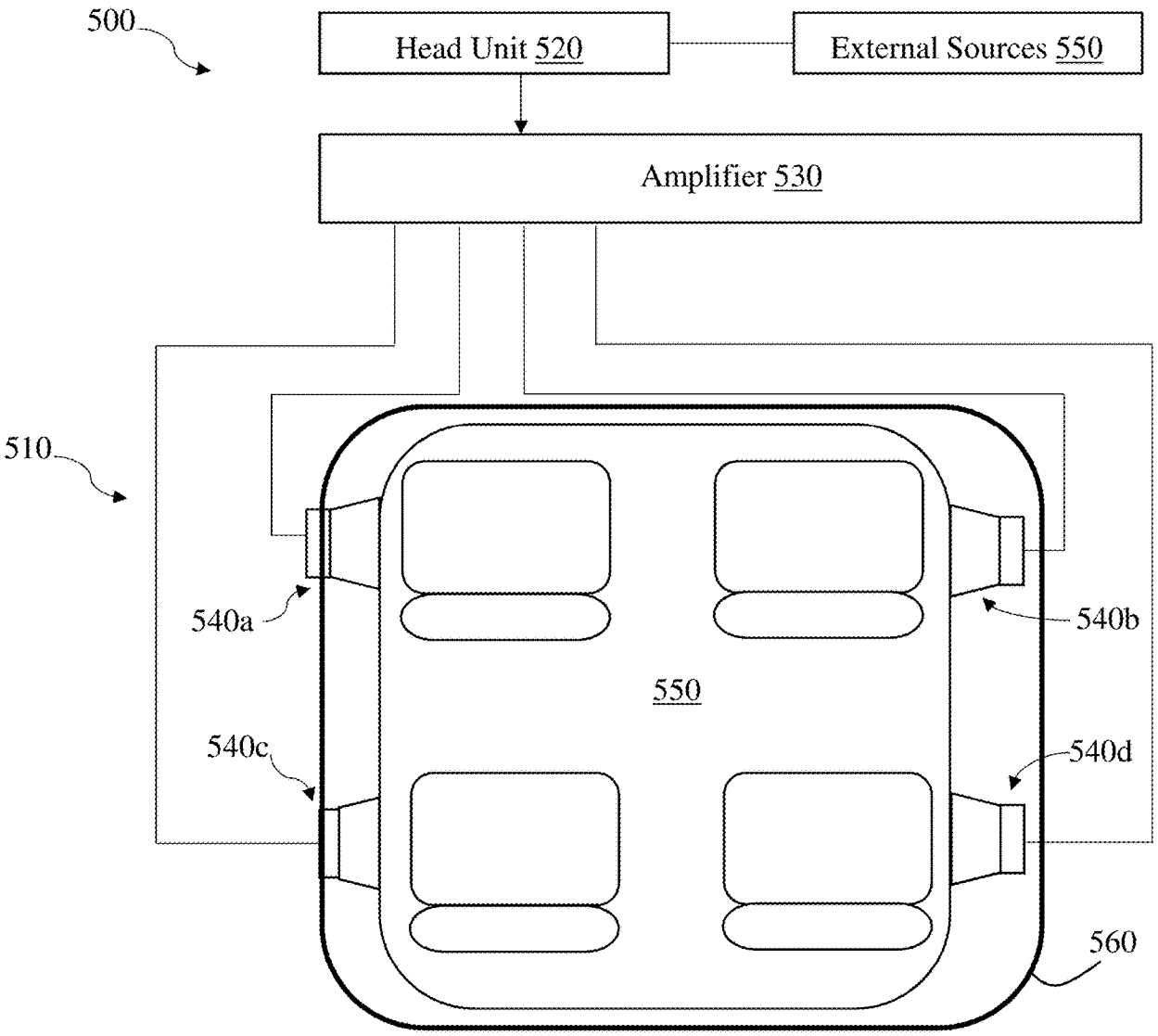
FIG. 5 is a schematic depiction of an audio system in an automobile according to various implementations.

As described herein, the loudspeakers 200, 300, 400 disclosed according to various implementations can be located in a vehicle. For example, loudspeakers disclosed according to various implementations can be located in one or more portions of a vehicle cabin. FIG. 5 shows an example audio system 500 in a vehicle (e.g., an automobile) 510 according to various implementations. The vehicle 510 depicts a wagon or hatchback automobile configuration including a loudspeaker on each of the four doors. It is understood that this configuration is only one example of an audio system used to illustrate various implementations of the disclosure, and that a variety of additional configurations can be utilized with these implementations.

The vehicle audio system 500 is shown in simplified form including a head unit 520, an amplifier 530, and four speakers 540 (labeled individually as 540*a-d*). The head unit 520 provides a user (also referred to as "occupant") with AM/FM tuning, audio source selection, and media (e.g., digital media and/or CD) playback capability. The head unit 520 is also able to receive signals from external sources 550, such as digital music players (e.g., mp3, CD, DVD music players), portable navigation device(s), a satellite radio receiver, cellular telephones, cloud-based music sources and/or other sources.

The head unit 520 provides an entertainment audio signal to the amplifier 530. As used herein, "entertainment audio", "entertainment audio signals", and similar terms can refer to any audio signal conventionally provided for playback in a vehicle audio system. For example, entertainment audio signal(s) can include radio transmissions, streaming audio signals, and/or recorded, downloaded, or otherwise accessible audio signals. These signals can include music, talk shows, podcasts, audio books, etc., and can be accessible from any sources described herein.

The amplifier 530 can include one or more combined source/processing/amplifying units. In some examples, the different functions may be divided between multiple components. In particular, the source is often separated from the amplifier, and the processing is provided by either the source or the amplifier, though the processing may also be provided by a separate component. The processing may also be provided by software loaded onto a general purpose computer providing functions of the source and/or the amplifier. We refer to signal processing and amplification provided by "the system" or "circuitry" generally, without specifying any particular system architecture or technology.

Additionally, the amplifier 530 can include a control system including hardware and/or software for controlling signal processing and additional functions described herein. It is further understood that one or more aspects of the amplifier 530, including the control system (and its corresponding functions) can be implemented using one or more remote computing devices (e.g., cloud computing devices) which are programmatically linked with the amplifier 530. As noted herein, the amplifier 530 can include any software-based, electrical and/or electro-mechanical control configuration capable of receiving control instructions (e.g., via an interface or other communication protocol) and adjusting presentation of audio content to a listener.

One or more of the speakers 540 can include a loudspeaker such as those disclosed herein, e.g., loudspeaker 200 (FIG. 2), loudspeaker 300 (FIG. 3) or loudspeaker 400 (FIG. 4). In some particular cases, one or more of the loudspeakers 200, 300, 400 can be configured such that the region outside of the interior space of the vehicle 510 is a space that is exterior to the body of the vehicle 510. For example, speakers 540*a* and 540*c* are shown spanning between the interior space of the vehicle (outputting to cabin 550) and the exterior of the body 560 of the vehicle 510. In this case, the "vehicle exterior" referenced with respect to loudspeakers 200, 300, 400 is exterior to the body 560 of the vehicle (e.g., ambient air). In one particular case, shown in the example speaker 540*a*, the passive radiator is located external to the external wall of the body 560, such that a portion of the backside of the passive radiator is external to the body 560. In another particular case, shown in the example speaker 540*c*, the passive radiator is formed in the exterior wall of the body 560, such that the backside of the passive radiator is external to the body 560.

In other implementations, the "vehicle exterior" can include a space that is outside of the interior space of the vehicle 510 (shown as cabin 550), but within the body 560 of the vehicle 510. This scenario is depicted with speakers 540*b* and 540*d*, which are shown spanning between the cabin 550 and a space within the body 560, e.g., within one or more doors of the vehicle. This scenario is only one example in which the loudspeaker can span between the cabin 550 and a space within the body 560 of the vehicle 510.

For example, in other cases, this space within the body 560 of the vehicle 510 can include a space within a trunk of the vehicle 510, e.g., between a cabin panel and a trunk panel, or within the trunk space itself. In other cases, the space within the body 560 can include a space within a dashboard of the vehicle 510, e.g., a space behind the dashboard panel in front of the engine or battery compartment. In still other cases, the space within the body 560 can include a space within a floor of the vehicle 510, e.g., between the floor plate and mechanical components in the drive train. In yet further implementations, the space within the body 560 can include a space within a headboard of the vehicle 510, e.g., between the headboard panel and the roof. In other implementations, the space within the body 560 can include a space within a seat of the vehicle 510 (e.g., between a seat front and a seatback, or within a seat cushion or headrest). In additional implementations, the space within the body 560 can include a space within a cargo load of the vehicle 510, e.g., a storage cabin or glove compartment. In further implementations, the space within the body 560 can include a space within a bumper of the vehicle 510 or a space within a fender panel of the vehicle 510. In still further implementations, the space within the body 560 can include a space within a structural member of the vehicle 510, e.g., within a component in the vehicle frame.

In any case, the loudspeakers 200, 300, 400 disclosed according to various implementations can enhance the perceived sound quality within a vehicle, as well as improve the system design options available for audio systems employing such loudspeakers. For example, in the case of loudspeaker 200, this configuration can limit a correlation between the resonant frequency of the enclosure 240 and the resonant frequency of the transducer 210 for each acoustic design parameter, enhancing the system design when compared with conventional loudspeaker configurations. Additionally, the loudspeakers 200, 300, 400 disclosed according to various implementations can mitigate unwanted audio effects from the exterior of the vehicle cabin while still providing quality low frequency sound.

The following Examples illustrate mathematical modeling of some of the loudspeakers described according to implementations in view of the conventional configuration described in the '991 patent (and shown in the model in FIG. 1).

EXAMPLES

The behavior of the system disclosed in the '991 patent is illustrated in model form in FIG. 1. The following equation can be used to describe this behavior:

$$\begin{cases} S_p \cdot (p_{ext}(t) - p_v(t)) = \rho \cdot S_p \cdot L_p \cdot \frac{d^2}{dt^2} x_p(t) \\ p_v(t) = P_0 \cdot \left(1 + \frac{\gamma}{V_v} \cdot (S_p \cdot x_p(t) + S_t \cdot x_t(t))\right) \\ f_t(t) + S_t \cdot (p_{int}(t) - p_v(t)) - K_t \cdot x_t(t) - R_t \cdot \frac{d}{dt} x_t(t) = M_t \cdot \frac{d^2}{dt^2} x_t(t) \end{cases} \quad (1)$$

In Equation 1, variables include the following: $x_p(t)$ is the displacement of the air in the port, $p_v(t)$ is the pressure of the air in the enclosure, $x_t(t)$ is the displacement of the transducer diaphragm, $f_t(t)$ is the force of the transducer motor applied to the diaphragm, $p_{ext}(t)$ is the pressure of the vehicle exterior and $p_{int}(t)$ is the pressure of the vehicle interior. The parameters, $S_p$ and $L_p$ are the cross-sectional area and the length of the duct, $V_v$ is the volume of the enclosure, $S_t$ and $M_t$ are the area and the mass of the transducer diaphragm, $K_t$ and $R_t$ are the stiffness and the damping of the diaphragm suspension of the transducer, $P_0$ is the atmospheric pressure, $\rho$ and $\gamma$ are the density and the specific-heat ratio of the air.

Considering this model as an acoustic transducer, $p_{ext}(t)$ and $p_{int}(t)$ are assumed as constant $P_0$ for simplicity.

$$p_{ext}(t)=p_{int}(t)=P_0 \quad (2)$$

Then the transfer function $H_{e1}(s)$ to describe the acoustic gain from motor force can be obtained by applying the Laplace transformation to the equation (1). Note that s is the projection of the time variable t by the Laplace transformation.

$$H_{e1}(s) = \frac{x_t(s) \cdot s}{f_t(s)} \quad (3)$$

Then defining the objective design parameter as X, the parameter sensitivity function is given by:

$$\delta_{e1}(s, X) = \frac{\partial H_{e1}(s, X)}{\partial X} \cdot \frac{X}{H_{e1}(s, X)} \quad (4)$$

In a similar way, considering this model as a transmission path of acoustic noise from the vehicle exterior to interior, it was assumed that f(t) is zero and $p_{int}(t)$ is constant $P_0$ for simplicity.

$$f_t(t)=0$$

$$p_{int}(t)=P_0 \quad (5)$$

Then the transfer function $H_{e2}(s)$ to describe the external noise transmission gain, and its parameter sensitivity function $\delta_{e2}(s, X)$ are given by:

$$H_{e2}(s) = \frac{x_t(s) \cdot s}{p_{ext}(s)} \quad (6)$$

$$\delta_{e2}(s, X) = \frac{\partial H_{e2}(s, X)}{\partial X} \cdot \frac{X}{H_{e2}(s, X)} \quad (7)$$

To see the practical trend of these functions, it is possible to consider the nominal value for each parameter (shown in Table 1), which are typical values for 9-inch speaker system.

TABLE 1

Nominal parameter values for the existing configuration model in the '991 patent:

| | | | | | |
|---|---|---|---|---|---|
| $S_p$ | 0.008 | [m$^2$] | $R_t$ | 0.5 | [N/m/s] |
| $L_p$ | 0.2 | [m] | $K_t$ | 3000 | [N/m] |
| $V_v$ | 0.001 | [m$^3$] | $P_0$ | 101325 | [Pa] |
| $S_t$ | 0.03 | [m$^2$] | $\rho$ | 1.293 | [kg/m$^3$] |
| $M_t$ | 0.04 | [kg] | $\gamma$ | 1.4 | |

FIG. 6 is the magnitude responses of $H_{e1}(s)$ and $\delta_{e1}(s, X)$, and FIG. 7 is the magnitude responses of $H_{e2}(s)$ and $\delta_{e2}(s, X)$. The peak A in the FIGURES of $H_{e1}(s)$ and $H_{e2}(s)$ is mainly the effect by the mechanical resonance of the transducer unit, which defines the lower limit of the sound reproduction frequency range. The peak B is the effect mainly by the Helmholtz resonance of the enclosure and the duct, which defines the frequency where the noise reduction is minimized.

The major design parameters of this model are $L_p$, $S_p$, and $V_v$. In view of $\delta_{e1}(s, L_p)$, $\delta_{e1}(s, S_p)$, $\delta_{e2}(s, L_p)$ and $\delta_{e2}(s, S_p)$ responses, $L_p$ and $S_p$ have high sensitivity to both peak A and B. Though $V_v$ has high sensitivity only to peak B, it is still difficult to find an appropriate parameter set to balance those two resonances.

Configuration According to Various Implementations

To solve the above-noted problem of enhanced noise intrusion, configurations according to various implementations (e.g., as shown in FIG. 2) were modelled. In one example, the behaviour of this model is given by:

$$\begin{cases} S_r \cdot (p_{ext}(t) - p_p(t)) - K_r \cdot x_r(t) - R_r \cdot \frac{d}{dt} x_r(t) = M_r \cdot \frac{d^2}{dt^2} x_r(t) \\ p_p(t) = P_0 \cdot \left(1 - \frac{\gamma}{S_p \cdot L_p}(S_p \cdot x_p(t) - S_r \cdot x_r(t))\right) \\ S_r \cdot p_p(t) - S_p \cdot p_v(t) = \rho \cdot L_p \cdot S_p \cdot \frac{d^2}{dt^2}\left(\frac{x_r(t) + x_p(t)}{2}\right) \\ p_v(t) = P_0 \cdot \left(1 + \frac{\gamma}{V}(S_p \cdot x_p(t) + S_t \cdot x_t(t))\right) \\ f(t) - S_t \cdot (p_v(t) - p_{int}(t)) - K_t \cdot x_t(t) - R_t(t) \frac{d}{dt} x_t(t) = M_t \cdot \frac{d^2}{dt^2} x_t(t) \end{cases} \quad (8)$$

In addition to the previous model for the conventional system in the '991 patent, in this example implementation, variable $x_r(t)$ is the displacement of the passive radiator. The parameters, $S_r$ and $M_r$ are the area and the mass of the passive radiator diaphragm, $K_r$ and $R_r$ are the stiffness and the damping of the suspension to hold that passive radiator diaphragm.

By the same procedure described in the previous section (with reference to the '991 patent), the acoustic gain transfer function $H_{p1}(s)$ and its parameter sensitivity function $\delta_{p1}(s, X)$ are given by:

$$H_{p1}(s) = \frac{x_t(s) \cdot s}{f_t(s)} \quad (9)$$

$$\delta_{p1}(s, X) = \frac{\partial H_{p1}(s, X)}{\partial X} \cdot \frac{X}{H_{p1}(s, X)} \quad (10)$$

The noise gain transfer function $H_{p2}(s)$ and its parameter sensitivity function $\delta_{p2}(s, X)$ are given by:

$$H_{p2}(s) = \frac{x_t(s) \cdot s}{p_{ext}(s)} \tag{11}$$

$$\delta_{p2}(s, X) = \frac{\partial H_{p2}(s, X)}{\partial X} \cdot \frac{X}{H_{p2}(s, X)} \tag{12}$$

To see the practical trend of these functions, the nominal value for each parameter was considered (shown in the Table 2), which are the typical values for 9-inch speaker system with a passive radiator.

TABLE 2

Nominal parameter values for the model according to various implementations:

| | | | |
|---|---|---|---|
| $S_p$ | 0.008 [m$^2$] | $S_t$ | 0.03 [m$^2$] |
| $L_p$ | 0.2 [m] | $M_t$ | 0.04 [kg] |
| $V_v$ | 0.001 [m$^3$] | $K_t$ | 3000 [N/m] |
| $S_r$ | 0.015 [m$^2$] | $R_t$ | 0.5 [N/m/s] |
| $M_r$ | 0.04 [kg] | $P_0$ | 101325 [Pa] |
| $K_r$ | 1000 [N/m] | $\rho$ | 1.293 [kg/m$^3$] |
| $R_r$ | 0.5 [N/m/s] | $\gamma$ | 1.4 |

FIG. 8 is the magnitude responses of $H_{p1}(s)$ and $\delta_{p1}(s, X)$, and FIG. 9 is the magnitude responses of $H_{p2}(s)$ and $\delta_{p2}(s, X)$. Comparable with the model for the '991 patent configuration described in the previous section, the peak A and B are the effect of the transducer resonance and the duct resonance.

The major design parameters of this example model are $L_p$, $S_p$, $V_v$, $S_r$, $M_r$, and $K_r$, but only the sensitivity response for $L_p$, $V_v$ and $K_p$ are inserted, since no signatures were found in other responses.

In view of $\delta_{p1}(s, L_p)$, $\delta_{p1}(s, V_v)$, $\delta_{p2}(s, L_p)$ and $\delta_{p2}(s, V_v)$ responses, $L_p$ and $V_v$ have high sensitivity to duct resonance while having less sensitivity to the transducer resonance. On the other hand, $K_r$ has high sensitivity to the transducer resonance while having less sensitivity to the duct resonance. Thus, the two major resonances in this example model, i.e., the transducer resonance and the duct resonances can be controlled quasi-individually by these two design parameters, easing the determination of a good parameter set to balance the acoustic gain as a transducer and noise transmission gain as a noise filter. This example data confirmed the benefit of the configurations disclosed according to various implementations when compared with the configuration in the '991 patent.

A number of implementations have been described. Nevertheless, it will be understood that additional modifications may be made without departing from the scope of the inventive concepts described herein, and, accordingly, other embodiments are within the scope of the following claims.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Operations may be performed by analog circuitry or by a microprocessor executing software that performs the mathematical or logical equivalent to the analog operation. Unless otherwise indicated, signal lines may be implemented as discrete analog or digital signal lines, as a single discrete digital signal line with appropriate signal processing to process separate streams of audio signals, or as elements of a wireless communication system. Some of the processes may be described in block diagrams. The activities that are performed in each block may be performed by one element or by a plurality of elements, and may be separated in time. The elements that perform the activities of a block may be physically separated. Unless otherwise indicated, audio signals or video signals or both may be encoded and transmitted in either digital or analog form; conventional digital-to-analog or analog-to-digital converters may not be shown in the figures.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions described herein. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

We claim:

1. A loudspeaker for a vehicle, the loudspeaker comprising:

a transducer to radiate sound into an interior space of the vehicle; and an assembly coupled to a rear side of the transducer, the assembly comprising an enclosure and a passive radiator, the assembly disposed such that acoustic energy radiated from the rear side of the transducer passes through the enclosure and excites the passive radiator, causing the passive radiator to radiate acoustic energy to a region outside of the interior space of the vehicle, wherein a resonant frequency of the transducer is dependent on at least one characteristic of the passive radiator, and a resonant frequency of the enclosure is dependent on at least one characteristic of the enclosure, wherein the enclosure comprises a chamber and a duct that couples the passive radiator to the chamber, and the resonant frequency of the transducer is dependent on at least one of: a volume of the chamber, a cross-sectional area of the passive radiator, a mass of the passive radiator, a loss factor of the passive radiator or a stiffness of the passive radiator, and wherein the resonant frequency of the transducer is further dependent on acoustic properties of the duct.

2. The loudspeaker of claim 1, wherein the resonant frequency of the transducer is further dependent on a cross-sectional area of the duct and a length of the duct.

3. The loudspeaker of claim 2, wherein the cross-sectional area of the duct remains approximately constant along the length of the duct.

4. The loudspeaker of claim 2, wherein the cross-sectional area of the duct varies along the length of the duct from the transducer to the passive radiator.

5. The loudspeaker of claim 1, wherein the transducer is coupled to a proximal end of the enclosure and the passive radiator is coupled to a distal end of the enclosure.

6. The loudspeaker of claim 1, wherein the interior space of the vehicle comprises a passenger cabin of the vehicle.

7. The loudspeaker of claim 6, wherein the region outside of the interior space of the vehicle comprises a space that is exterior to a body of the vehicle.

8. The loudspeaker of claim 6, wherein the region outside of the interior space of the vehicle comprises a space within a body of the vehicle.

9. The loudspeaker of claim 8, wherein the space within the body of the vehicle comprises a space within a door of the vehicle, a space within a trunk of the vehicle, a space within a dashboard of the vehicle, a space within a floor of the vehicle, a space within a headboard of the vehicle, a space within a seat of the vehicle, a space within a cargo load of the vehicle, a space within a bumper of the vehicle, a space within a fender panel of the vehicle, or a space within a structural member of the vehicle.

10. The loudspeaker of claim 1, wherein the passive radiator limits a correlation between the resonant frequency of the enclosure and the resonant frequency of the transducer.

11. The loudspeaker of claim 1, wherein the enclosure comprises a space defined by a set of walls enveloping the rear side of the transducer.

12. The loudspeaker of claim 11, wherein the passive radiator is located at least partially within the set of walls of the enclosure.

13. The loudspeaker of claim 11, wherein the enclosure has a length measured from the rear side of the transducer to the passive radiator, wherein the enclosure has a constant cross-sectional area along the length, and wherein the passive radiator has an outer dimension that is smaller than an inner dimension of the enclosure.

14. An automobile comprising the loudspeaker of claim 1.

15. A loudspeaker for a vehicle, the loudspeaker comprising:

a transducer to radiate sound into an interior space of the vehicle, wherein the interior space of the vehicle comprises a passenger cabin of the vehicle; and an assembly coupled to a rear side of the transducer, the assembly comprising an enclosure and a passive radiator, the assembly disposed such that acoustic energy radiated from the rear side of the transducer passes through the enclosure and excites the passive radiator, causing the passive radiator to radiate acoustic energy to a region outside of the interior space of the vehicle, wherein a resonant frequency of the transducer is dependent on at least one characteristic of the passive radiator, and a resonant frequency of the enclosure is dependent on at least one characteristic of the enclosure, wherein the passive radiator limits a correlation between the resonant frequency of the enclosure and the resonant frequency of the transducer.

16. The loudspeaker of claim 15, wherein the enclosure comprises a space defined by a set of walls enveloping the rear side of the transducer, and wherein the passive radiator is located at least partially within the set of walls of the enclosure.

17. A loudspeaker for a vehicle, the loudspeaker comprising:

a transducer to radiate sound into an interior space of the vehicle; and an assembly coupled to a rear side of the transducer, the assembly comprising an enclosure and a passive radiator, the assembly disposed such that acoustic energy radiated from the rear side of the transducer passes through the enclosure and excites the passive radiator, causing the passive radiator to radiate acoustic energy to a region outside of the interior space of the vehicle, wherein a resonant frequency of the transducer is dependent on at least one characteristic of the passive radiator, and a resonant frequency of the enclosure is dependent on at least one characteristic of the enclosure, and wherein the passive radiator limits a correlation between the resonant frequency of the enclosure and the resonant frequency of the transducer.

18. The loudspeaker of claim 17, wherein the enclosure comprises a space defined by a set of walls enveloping the rear side of the transducer, and wherein the passive radiator is located at least partially within the set of walls of the enclosure.

19. The loudspeaker of claim 18, wherein the interior space of the vehicle comprises a passenger cabin of the vehicle.

* * * * *